US006735812B2

(12) United States Patent
Hekman et al.

(10) Patent No.: US 6,735,812 B2
(45) Date of Patent: May 18, 2004

(54) DUAL MODE CARPET CLEANING APPARATUS UTILIZING AN EXTRACTION DEVICE AND A SOIL TRANSFER CLEANING MEDIUM

(75) Inventors: Frederick A. Hekman, Holland, MI (US); Jeffrey D. Fystrom, Holland, MI (US); Larry D. Wydra, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 10/371,940

(22) Filed: Feb. 21, 2003

(65) Prior Publication Data

US 2003/0159232 A1 Aug. 28, 2003

Related U.S. Application Data

(63) Continuation-in-part of application No. 10/081,374, filed on Feb. 22, 2002.

(51) Int. Cl.[7] ..... A47L 11/30

(52) U.S. Cl. ..... 15/320; 15/340.2; 15/383; 15/384; 134/21

(58) Field of Search ..... 15/320, 340.2, 15/340.3, 340.4, 383, 384; 134/21

(56) References Cited

U.S. PATENT DOCUMENTS

| | | | | |
|---|---|---|---|---|
| 990,775 A | | 4/1911 | Reid | |
| 1,268,963 A | * | 6/1918 | Gray | 15/320 |
| 2,518,183 A | | 8/1950 | Renne | |
| 3,631,558 A | | 1/1972 | Kovacevic | |
| 3,696,458 A | | 10/1972 | Leifheit | |
| 3,750,217 A | | 8/1973 | Liebscher | |
| 3,761,985 A | | 10/1973 | Leifheit | |
| 3,843,989 A | | 10/1974 | DeMaagd | |
| 3,875,605 A | | 4/1975 | Fegan | |
| 3,936,199 A | | 2/1976 | Zimmermann | 401/40 |
| 3,983,592 A | | 10/1976 | Fegan | 15/49.1 |
| 4,245,371 A | | 1/1981 | Satterfield | 15/320 |
| 4,360,946 A | * | 11/1982 | Marshall et al. | 15/321 |
| 4,369,544 A | | 1/1983 | Parisi | 15/320 |
| 4,433,451 A | | 2/1984 | Parisi | 15/321 |
| 4,570,278 A | | 2/1986 | Bloome et al. | 15/97 |

(List continued on next page.)

FOREIGN PATENT DOCUMENTS

| | | |
|---|---|---|
| DE | 6934247 | 8/1969 |
| DE | 3616398 | 12/1986 |
| DE | 4117957 | 12/1992 |
| DE | 10020197 | 11/2001 |
| EP | 0286328 | 10/1988 |
| JP | 5123278 | 5/1993 |
| WO | 9749324 | 12/1997 |
| WO | WO03/003897 | 1/2003 |

*Primary Examiner*—Theresa T. Snider
(74) *Attorney, Agent, or Firm*—Fulbright & Jaworski L.L.P.

(57) ABSTRACT

An apparatus performing multiple different cleaning operations for cleaning fabrics, floor coverings, and bare floor surfaces is disclosed. A device according to the present invention selectively utilizes soil transfer and solution extraction technology. In one embodiment, an apparatus is disclosed having a cleaning implement in selective wiping contact with a surface to be cleaned, a cleaning solution dispenser which selectively wets with a cleaning solution a portion of the cleaning implement or a portion of the surface or both, a first selectively controllable vacuum extractor tool which when operating removes some of the dispensed cleaning solution and soil from the cleaning implement, and a second selectively controllable vacuum extractor tool which when operating removes soil and some of the cleaning solution directly from the surface intended to be cleaned. A method of use of such an apparatus is also disclosed. Portable and vehicle-based devices may be utilized to practice the different methods of cleaning.

35 Claims, 5 Drawing Sheets

U.S. PATENT DOCUMENTS 4,654,916 A 4/1987 Postonen et al. ..... 15/50
4,822,431 A * 4/1989 Bricher et al. ..... 15/320
4,845,794 A 7/1989 Korski et al. ..... 15/51
4,884,310 A 12/1989 Knestele ..... 15/3
4,914,773 A 4/1990 Ham ..... 15/3
4,956,891 A * 9/1990 Wulff ..... 15/320
5,086,539 A 2/1992 Rench ..... 15/384
5,203,047 A * 4/1993 Lynn ..... 15/99
5,241,724 A * 9/1993 Lim ..... 15/322
5,287,581 A 2/1994 Lo ..... 15/52
5,309,597 A 5/1994 Wymore ..... 15/22.3
5,371,912 A 12/1994 Hall ..... 15/98
5,404,609 A 4/1995 Rench ..... 15/52.1
5,465,456 A 11/1995 Fellhauer et al. ..... 15/320
5,483,718 A 1/1996 Blehert et al. ..... 15/50.3
5,515,568 A 5/1996 Larson et al. ..... 15/50.3
5,657,504 A 8/1997 Khoury ..... 15/98
5,697,119 A 12/1997 Mussalo ..... 15/320
5,699,576 A 12/1997 Sohaiby ..... 15/103
5,715,565 A * 2/1998 Kern ..... 15/302
5,797,163 A * 8/1998 Whitaker et al. ..... 15/320
5,813,086 A 9/1998 Ueno et al. ..... 15/320
5,867,861 A * 2/1999 Kasen et al. ..... 15/320
5,901,410 A 5/1999 Windmeisser ..... 15/354
5,933,900 A 8/1999 Wang ..... 15/50.3
6,030,465 A * 2/2000 Marcussen et al. ..... 15/320
6,055,699 A 5/2000 Cho ..... 15/321
6,088,873 A 7/2000 Pacchini et al. ..... 15/320
6,145,145 A 11/2000 Besel ..... 15/22.3
2003/0033681 A1 2/2003 Blum et al. ..... 15/104.002

* cited by examiner

DUAL MODE CARPET CLEANING APPARATUS UTILIZING AN EXTRACTION DEVICE AND A SOIL TRANSFER CLEANING MEDIUM

RELATED APPLICATION

This application is a continuation-in-part and claims the benefit of priority pursuant to 35 U.S.C. 120 of U.S. Ser. No. 10/081,374, filed Feb. 22, 2002, which entire application is hereby incorporated by reference.

FIELD OF THE INVENTION

The present invention relates generally to surface maintenance or conditioning machines, and more particularly to those machines employing one or more surface maintenance or conditioning appliances or tools to perform a floor cleaning task.

BACKGROUND OF THE INVENTION

In general, proper carpet maintenance involves regular vacuuming and periodic cleaning to remove soil by methods such as hot water extraction, shampooing, bonnet cleaning, foam cleaning, etc. Some of the soil is loosely found between carpet fibers while other soil is held upon the carpet fibers by some means such as electrostatic forces, van der Waals forces, or oil bonding. Still other soil is mechanically trapped by carpet fibers. Regular vacuuming is essential as it removes some of the loose soil that damages the fibers. Vacuuming maintains the surface appearance of a carpet and keeps the level of soil in the pile at an acceptable level. Vacuuming removes only particulate soil and some unbound or loosely bound surface dirt, however, therefore, other methods of cleaning are periodically required to improve the appearance of the carpet. Wet cleaning methods are required to remove oils, greases, bound dirt, and other forms of matter that cause soiling on carpet. These methods are often used by professional cleaners and trained personnel.

One type of surface maintenance machine for carpet cleaning is referred to as a bonnet cleaner. Bonnet cleaners employ an absorbent bonnet or pad (hereinafter referred to as the "pad") attached to a rotary driver for rotating the pad about an axis generally perpendicular to the carpet surface. Most commonly a solution of cleaning liquid is sprayed directly onto the carpet and then the rotating pad is used to agitate the wetted carpet. This action transfers soil from the carpet onto the pad. Since the pad is commonly two-sided, the pad may be reversed once one side of the pad gets saturated or soiled to a selected level. The pad may be periodically replaced and later cleaned depending upon the application and wear characteristics of the pad.

The soil transfer process of the bonnet cleaners may be characterized as a "circular engagement process" since the pad rotates in a circular motion essentially in the plane of the carpet surface. The method employed by bonnet cleaners has the advantage of being fast drying if a relatively small amount of cleaning liquid is employed. However the process is fundamentally unstable since the rotating pad starts out clean and becomes less and less effective as a cleaning tool as it collects soil. Additional limitations of bonnet cleaners include transferring soil from soiled areas to relatively cleaner areas, leaving much of the cleaning fluid in the carpet, and having the potential to damage the carpet. With respect to the latter, some carpets, particular twisted ply variations, may be damaged by aggressive engagement with the rotating pad. Additionally, the bonnet cleaning process is a relatively labor intensive process since the pad requires frequent soil monitoring and frequent removal of soiled pads.

Yet another limitation of bonnet cleaners is the relatively uncontrolled use of cleaning liquid in the carpet cleaning process as some areas of the carpet may receive more cleaning liquid spray than other areas. Reliance on operator spraying of cleaning liquid to the carpet surface may result in over wetting of some areas and under wetting of other areas.

Another type of surface maintenance machine designed for carpet cleaning is referred to as a "hot water extractor" or an "extractor machine." Extractor machines are commonly used for deep carpet cleaning. In general, an extractor is a transportable self-contained device which (i) sprays cleaning liquid directly onto the carpet to create a wetted carpet portion, (ii) agitates the wetted portion with a brush, and (iii) removes some of the cleaning liquid and soil in the carpet through a vacuum system. Generally, the extraction process applies a relatively large quantity of cleaning liquid on the carpet. While the vacuum system recovers a portion of the applied cleaning liquid, a significant portion is retained by the carpet. As a consequence, carpet drying times are substantially longer than in the bonnet cleaning process.

FIG. 4 illustrates functions of a conventional extractor machine 80. In general, extractor 80 is a transportable self-contained device which (i) sprays cleaning liquid directly onto the carpet to create a wetted carpet portion, (ii) agitates the wetted portion with a brush, and (iii) removes some of the cleaning liquid and soil in the carpet through a vacuum system. Components of a conventional extractor machine 80 include a solution tank 82, a pump 84 for conveying solution from tank 82, and a spray nozzle 86 for spraying solution onto a floor surface 88. A brush motor 90 powers a brush 92 which engages the floor surface 88. Subsequently, as the machine is move in an operational direction, a pickup tool or "extractor" 94 engages the floor surface 88 to remove soiled solution from the surface 88. A vacuum fan 96 and recovery tank 98 are provided to respectively remove and receive soiled solution from surface 88. Additional features of an extractor machine are disclosed in U.S. Pat. No. 4,956,891, assigned to Tennant Company, and incorporated herein by reference.

Another type of surface maintenance machine intending for carpet cleaning has been developed by Tennant Company and is the subject of U.S. application Ser. No. 10/081,374, entitled "Apparatus and Method for Cleaning Fabrics, Floor Coverings, and Bare Floor Surfaces Utilizing a Soil Transfer Cleaning Medium", incorporated by reference herein. This method does not spray the water directly onto the surface being cleaned at all. Instead, In accordance with that invention, a revolving cleaning medium, such as a cylindrical roll, is wetted and wiped against a surface intended to be cleaned. In general, this method of cleaning includes the steps of (i) wetting a revolving cleaning medium with a cleaning solution, (ii) removing at least some of the cleaning liquid from the revolving cleaning medium directly after wetting by way of a moisture extraction device, and (iii) wiping the surface with the revolving cleaning medium so as to transfer soil from the surface to the revolving cleaning medium and subsequently removing transferred soil from the revolving cleaning medium.

FIG. 5 illustrates a soil transfer roll carpet cleaning machine 102, such as taught in U.S. application Ser. No. 10/081,374. Components of a soil transfer roll cleaning machine 102 include a solution tank 104, a pump 106 for conveying solution from tank 104, and a spray nozzle 108 for spraying solution onto cleaning medium—rolls 100. Motors 110 drive rolls 100 which engage the floor surface 112. Extractors 114 engage the rolls 100 to remove soiled solution from rolls 100. A vacuum fan 116 and recovery tank 118 are provided to respectively remove and receive soiled solution 120 from rolls 100. In a preferred operation, one portion of the cleaning medium 100 is wetted with cleaning liquid, while another portion is being extracted to remove soil and cleaning liquid therefrom, and while yet another portion is being wiped against the surface to transfer soil from the surface to the cleaning medium 100. The process continues in a revolving or cyclical manner so that each portion of the cleaning medium 100 is sequentially wetted, extracted, and wiped against the surface

SUMMARY AND OBJECTS OF THE INVENTION

An object of the present invention is the provision of a dual mode carpet cleaning machine. Another object of one embodiment of the present invention is to significantly decrease the amount of cleaning solution applied to a carpet surface during at least one mode of operation. The benefits of reduced solution usage are 3-fold. First, reduced solution usage lowers the cost of operation since it requires less clean water and less cleaning chemical to clean a given area and it produces less waste water to be disposed of after cleaning. Second, reduced solution usage increases productivity since the cleaning equipment can be operated for longer periods of time without stopping to refill or empty the solution tanks. Third, reduced solution usage results in a significantly shorter dry time after the cleaning process has been completed and before the area can be reopened for use.

Yet another object of the present invention is the provision of a cleaning process and apparatus for cleaning a variety of surfaces, including but not limited to floor surfaces, stairways, walls, and upholstered furniture or other fabric surfaces.

In accordance with one embodiment of the present invention, a transportable device is utilized to perform at least two different cleaning process on a carpeted surface. The device may be a relatively portable machine having a cleaning liquid tank, a soiled solution recovery tank, a vacuum system, and cleaning head. The cleaning head may include a floor pickup tool and brushes or rolls and associated drive mechanism. Vacuum extractor tools may be used to engage the rolls or other surface to remove soil and at least some of the soiled cleaning liquid. Common parts such as motors and brushes may be utilized during the two different cleaning processes.

In accordance with one embodiment of the invention in a first mode of operation a carpet extraction process is performed. In the first mode of operation a cleaning solution is sprayed onto the surface and/or brushes and the brushes agitate the floor surface to transfer soil from the surface into a soiled cleaning solution. The soiled cleaning solution is subsequently removed from the surface via a vacuum extractor tool and transported into a soiled solution recovery tank. In a second mode of operation a soil transfer roll cleaning process is performed utilizing revolving soil transfer rolls having portions of each roll being successively wetted, extracted, and wiped against a surface intended to be cleaned.

DETAILED DESCRIPTION OF THE INVENTION

The present invention is directed both to a method of cleaning surfaces and an apparatus for performing the method. In a broad sense as will subsequently be described, the cleaning process in accordance with the present invention includes dual modes of operation.

Figure 1:
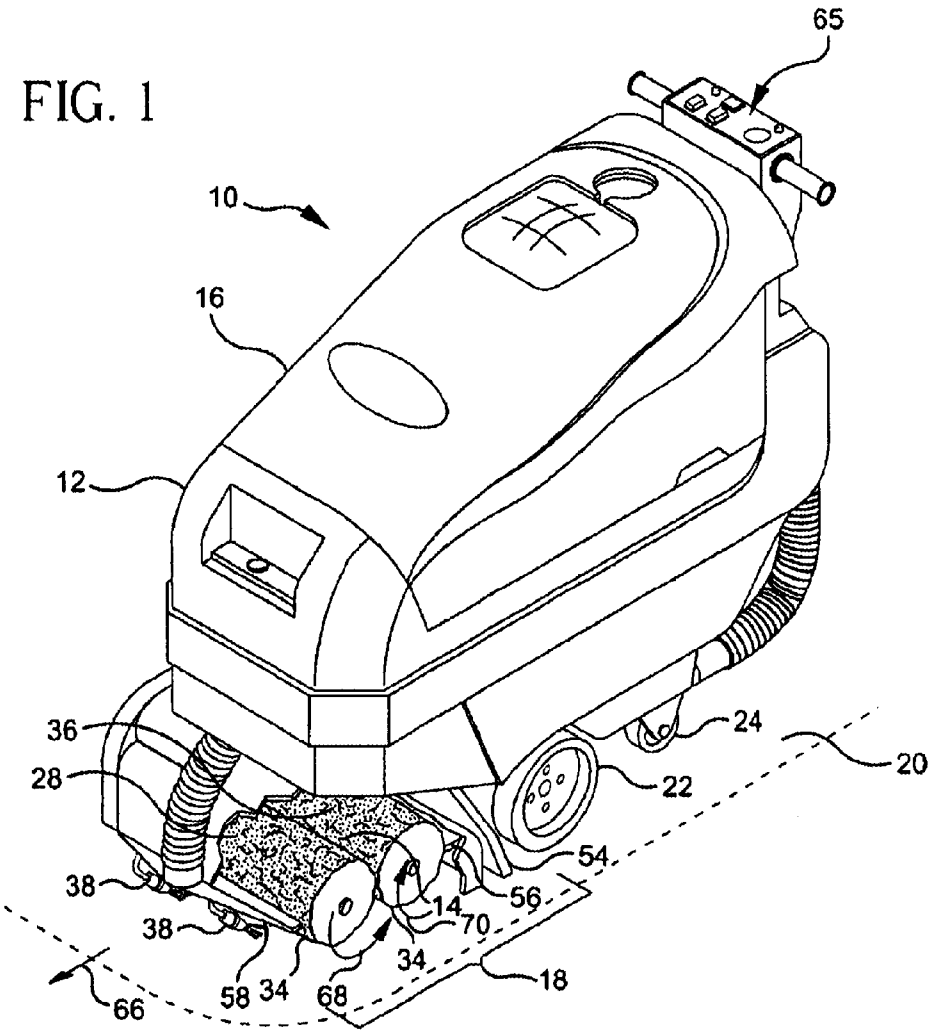
FIG. 1 is a perspective illustration of one embodiment of a cleaning machine according to the present invention.

FIG. 1 illustrates an embodiment of a transportable floor surface cleaning machine 10 according to the present invention. More particularly, machine 10, for illustrative purposes, is illustrated as a battery-powered walk-behind machine similar to those known in the art, including a cleaning solution tank 12 for containing a cleaning liquid 14, such as a mixture of water and a cleaning chemical, a recovery tank 16, a cleaning head 18, a cleaning liquid dispensing system, and a soiled solution extraction system as further described herein. In operation, machine 10 is supported upon the ground surface 20 by drive wheels 22 and caster wheels 24. Representative examples of battery-powered walk-behind carpet machines having a cleaning solution tank 12, recovery tank 16, cleaning liquid dispensing means, and a soiled solution vacuum extraction system include models 1510 and 1550 extractors manufactured by Tennant Company, Minneapolis, Minn. Cleaning head 18 is attached at a forward portion of the machine 10 via a positioning actuator (not shown). In alternative embodiments of the invention, cleaning head 18 may be attached at other portions of a machine. In an illustrated embodiment, cleaning head 18 in accordance with the present invention may be used in conjunction with one of such known walk-behind extractor machines and the like.

Figure 2:
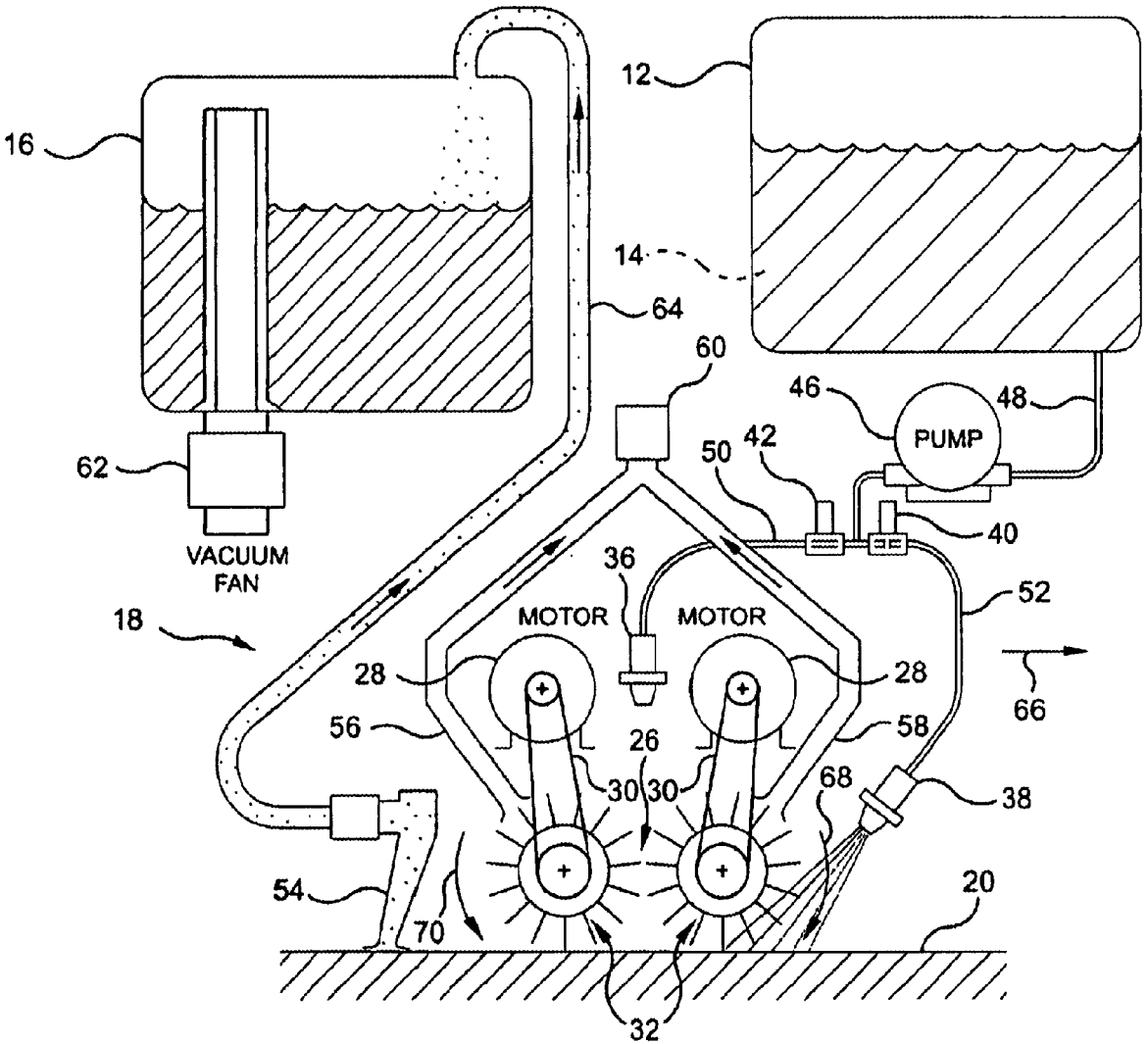
FIG. 2 is a diagrammatic illustration of the embodiment of FIG. 1 illustrating the machine in an extraction operation.
Figure 3:
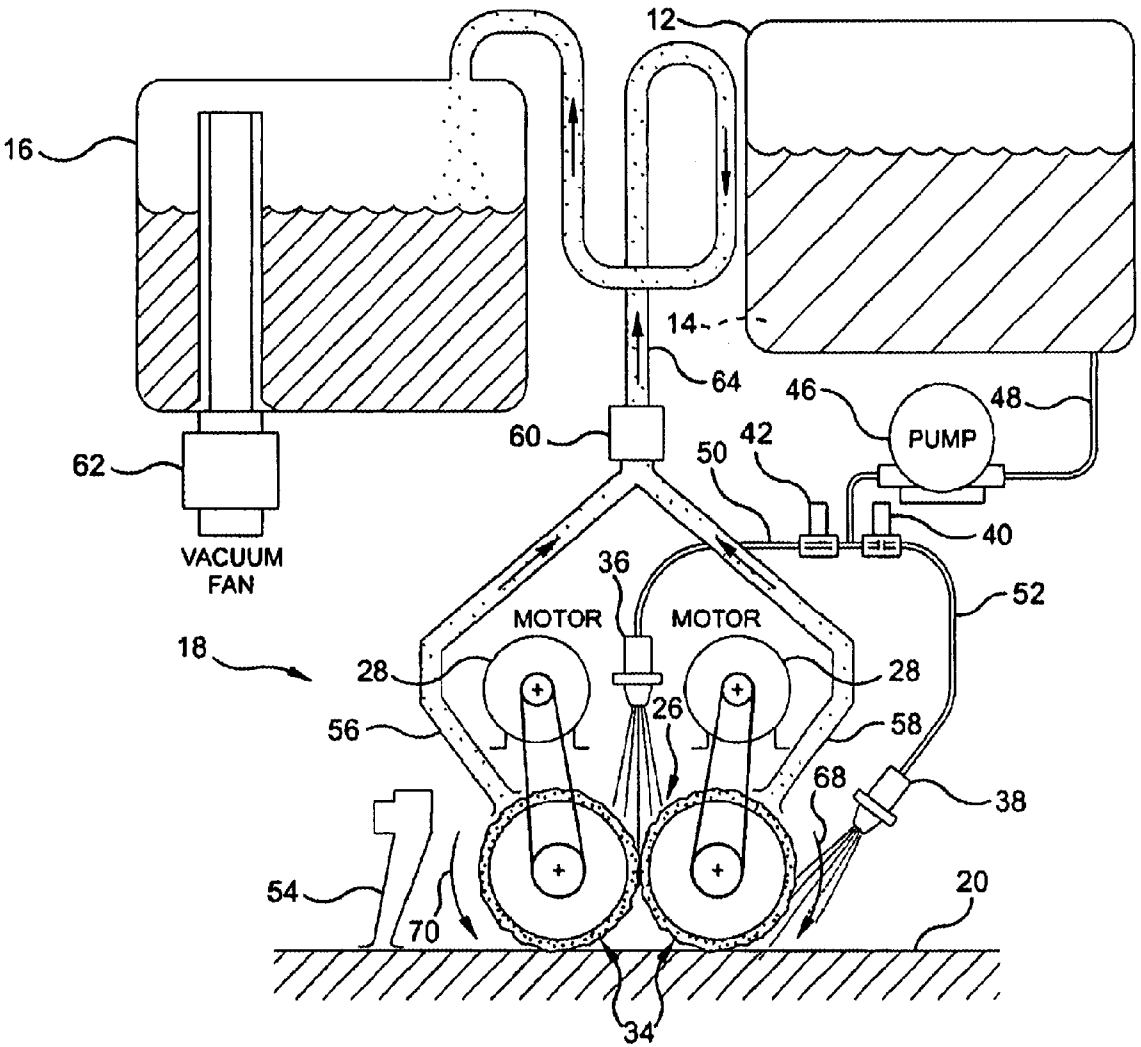
FIG. 3 is a diagrammatic illustration of the embodiment of FIG. 1 illustrating the machine in a soil transfer roll operation.
Figure 4:
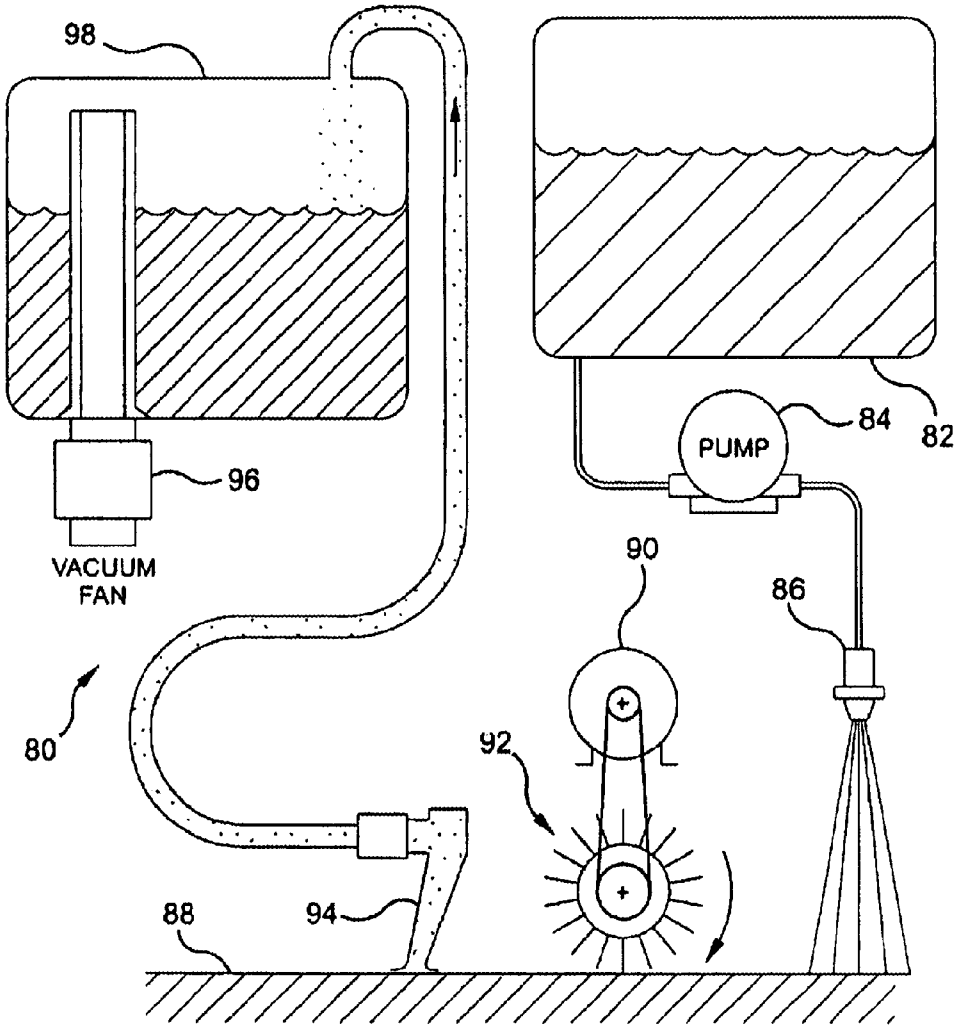
FIG. 4 Prior Art
FIG. 4 is a diagrammatic illustration of a prior art machine utilizing an extraction process.
Figure 5:
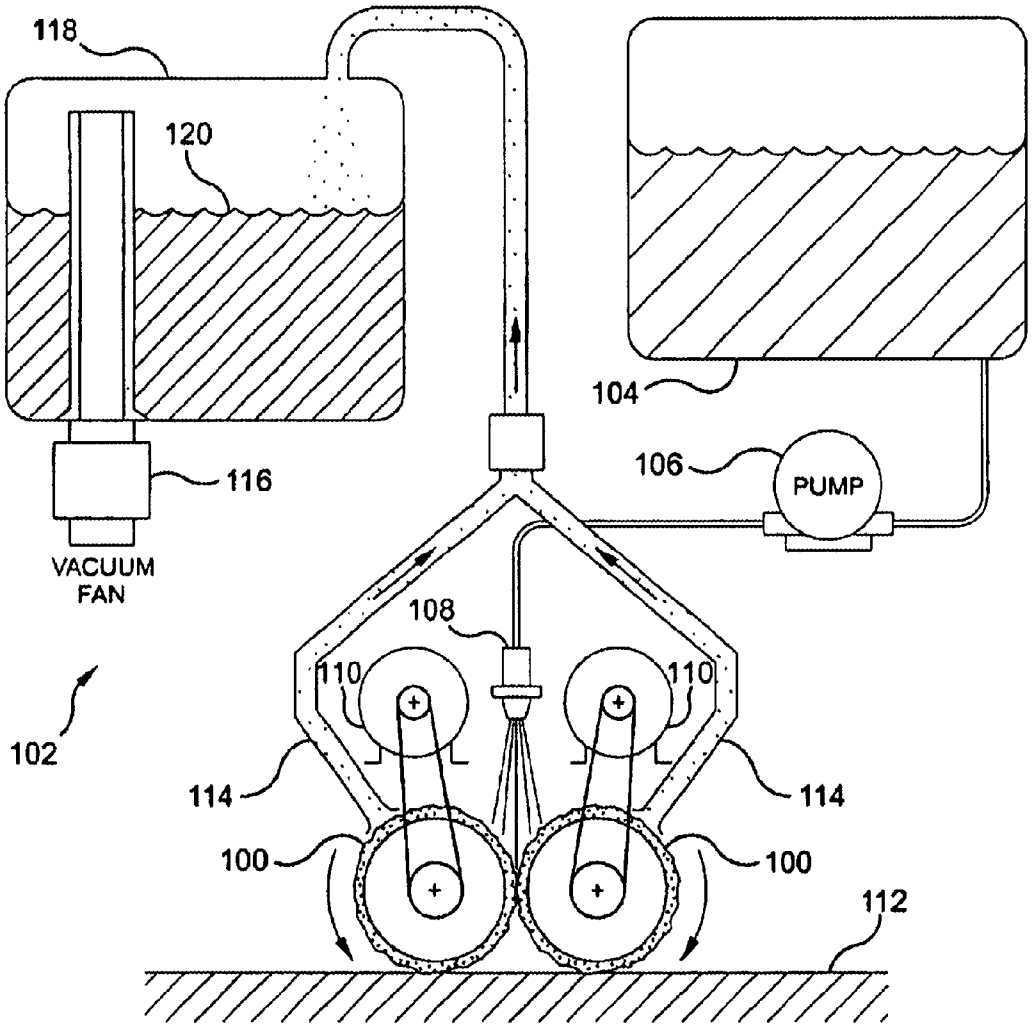
FIG. 5 is a diagrammatic illustration of a machine utilizing a soil transfer roll cleaning process.

Referring to FIGS. 2 and 3, cleaning head 18 in one embodiment of the present invention, includes a cleaning medium 26 and associated drive assembly as is more particularly shown in detail in FIGS. 2 and 3. Drive assembly includes drive motors 28 and belts 30 to rotate cleaning medium 26 relative to cleaning head 18 and surface 20. In the illustrated embodiment, cleaning medium 26 includes a pair brushes 32 for use in an extraction mode of operation (as depicted in FIG. 2) and a pair of soil transfer rolls 34 for use in a soil transfer roll mode of operation (as depicted in FIG. 3). As described in more detail hereinafter, cleaning medium 26 may alternatively include a combination brush/soil transfer roll suitable for use in both modes of operation. Brushes 32 and soil transfer rolls 34 of cleaning medium 26 are rotatably driven by cleaning medium drive assembly including drive belts 30 and electric motors 28.

Cleaning head 18 further includes two sets of spray nozzles 36, 38 for spraying cleaning solution 14 on the brushes 32, soil transfer rolls 34 and/or floor surface 20. The discharge of solution through roll spray nozzles 36 and floor spray nozzles 38 is controlled by activation of valves 40, 42. A fluid pump 46 is provided to pressurize cleaning solution 14.

In an exemplary embodiment of the invention, cleaning solution dispensing system includes pump 46 for selectively pumping cleaning liquid 14 through conduits 48, 50, 52 and nozzles 36, 38 thereby delivering cleaning liquid 14 to floor surface 20, soil transfer rolls 34, and/or brushes 32. Appropriate fluid controls, such as valves 40, 42 switches (not shown), etc. are provided to control the application of cleaning fluid 14. As depicted in FIG. 2, floor spray nozzle 38 discharges cleaning solution 14 to floor surface 20 and front extractor brush 32. As depicted in FIG. 3, roll spray nozzle 36 discharges cleaning solution 14 to soil transfer rolls 34 during a soil transfer roll mode of operation. Alternative dispensing means may include drip bars or gravity feed techniques, transfer rolls, etc.

Cleaning head 18 further includes a plurality of vacuum extraction tools 54, 56, 58 for removing soil solution from either the floor surface 20, the soil transfer rolls 34, or both. Extractors 54, 56, 58 each include an elongated slot and an outlet aperture. Extractors 56, 58 share a common outlet aperture 60. As depicted in FIG. 2, floor surface engaging extractor 54 is coupled to the vacuum system during an extraction mode of operation. Extractor 54 is configured to remove soiled solution from floor surface 20. As depicted in FIG. 3, extractors 56, 58 are configured to remove soiled solution from soil transfer rolls 34. Extractors 56, 58 are sized in relation to soil transfer rolls 34 to remove soiled solution across substantially the entire transverse length of the rolls 34. An alternative vacuum extractor system may include two separate outlets each having a separate conduit to recovery tank 16.

In operation, extractors 54, 56, 58 are selectively coupled to a vacuum-based solution recovery system including recovery tank 16 for soiled solution and vacuum fan 62. A vacuum conduit 64 may be selectively connected to either the floor surface engaging extractor 54 (FIG. 2) or the pair of roll extractors 56, 58 (FIG. 3). Vacuum conduit 64 may be connected between the different extractors 54, 56, 58 by manually switching conduit 64. Other manual valving may be practicable to make the connections in the vacuum recovery system. In another embodiment, vacuum connections of the soiled solution recovery system may be automatically performed, such as via a controlled valve, etc.

Referring again to FIG. 2, extractor brushes 32 may be bristle-type cylindrical brushes as known in the art. Referring to FIG. 3, soil transfer rolls 34 may of a variety of different materials. A combination of pad-like or bristle-like or foam-like materials, and the like, may be used. In a preferred embodiment a material such as a woven synthetic fabric, having pile fibers tufted thereunto is utilized. In one embodiment of the invention, the substrate has an appearance and feel that is similar to the surface fabric used on a common paint roller. In some instances, it may be desirable to intersperse stiffer fibers, i.e., brush-like bristles, into the substrate to enhance the agitation action of soil transfer rolls 34. It is further envisioned that a single "hybrid" roll design may be utilized during both modes of operation. A hybrid roll/brush design may contain aspects of a bristle brush and soil transfer roll material (fabric, pile structures, etc.). A hybrid roll design would eliminate the requirement of switching rolls 34 with brushes 32 during operational mode changes.

Operation of machine 10 will now be described. In operation, machine 10 is propelled across surface 20. To initiate a cleaning operation, appropriate controls 65, such as switches, are used to activate vacuum fan 62, motors 28, valves 40, 42, cleaning liquid pump 46, etc. At least two modes of operation are available, an extraction mode and a soil transfer roll mode. Switching between the two modes may entail a change of vacuum connections between extractors 54, 56, 58 and recovery tank 16, activation of valves 40, 42, and switching brushes 32 with soil transfer rolls 34.

In the extraction mode of operation (as depicted in FIG. 2), machine 10 functions similarly to known carpet extractors. Machine 10 operates in a direction as indicated by arrow 66. Cleaning solution 14 is pressurized by pump 46 and directed through valve 40 and conduit 52 to floor spray nozzle(s) 38. Cleaning solution discharged through nozzle (s) 38 is directed primarily onto the floor surface 20. Nozzle(s) 38 may also direct some cleaning solution onto front extractor brush 32. Extractor brushes 32 are driven via motors 28 to engage the floor surface and transfer soil into a soiled cleaning solution. Brushes 32 may include bristles to facilitate soil transfer. The direction of brush rotation is indicated by arrows 68, 70. As cleaning machine progresses across the floor surface 20, floor extractor 54 engages the wetted portion of the floor to remove soiled solution from the surface. Soiled solution is moved through vacuum conduit 64 and into recovery tank 16 by operation of vacuum fan 62.

A description of a second mode of operation, a soil transfer roll mode, may be made with reference to FIG. 3. One or more transfers between the two modes of operation may occur during a machine usage, e.g., an operator may perform the extraction process on a portion of a floor surface and perform the soil transfer roll process on another portion of the floor surface.

In the second mode of operation, soil transfer rolls 34 are wetted with cleaning liquid 14 by cleaning solution nozzle 36, then extracted by operation of roll extractors 56, 58 to remove soiled cleaning liquid, and then wiped against floor surface 20 so as to transfer soil from surface 20 onto soil transfer rolls 34. Soil transfer rolls 34 revolve by operation of motors 28 in directions as indicated by arrows 68, 70 so that different portions of the soil transfer rolls 34 are being wetted with cleaning liquid 14, extracted by roll extractors 56, 58, or wiped against surface 20.

In this second mode of operation, cleaning solution is pressurized via pump 46 and flows through valve 42 and conduit 50 toward roll nozzle(s) 36. Cleaning solution usage (solution volume/area of floor surface) during the second mode of operation (soil transfer roll cleaning) may be substantially less than during the first mode of operation (hot water extraction). Floor spray nozzle 38 may be optionally activated during the second mode of operation to increase the amount of solution 14 applied to floor 20.

In the soil transfer roll mode of operation, wetted portions of rolls 34 may be defined as those roll portions which receive cleaning liquid from the spray nozzle 36. Vacuum extractors 56, 58 each engage a roll 34 to remove some of the just deposited cleaning liquid 14 and soil previously transferred from the carpet surface 20. Each roll 34 is engaged by its associated vacuum extractor 56, 58 to reduce the local wetness of the roll 34. As a result, rotating rolls 34 have a wetted portion as defined above, and a reduced wetness portion which engages the carpet surface 20.

As rolls 34 are revolved, reduced wetness portions engage the carpet fibers and cause soil to be transferred from the carpet fibers to rolls 34. As rolls 34 are further rotated, the reduced wetness portions (having received soil from the carpet) are sprayed with cleaning liquid 14 by nozzle 36 and subsequently vacuum extracted by extractors 56, 58 to convey soiled cleaning liquid from rolls 34 into soiled solution recovery tank 16.

The soil transfer roll cleaning process thus includes the steps of wetting a portion of rolls 34 with cleaning liquid 14, reducing the relative wetness of the wetted portion of the rolls 34 by extraction, and wiping the surface with the rolls 34 so as to transfer soil from the surface to the rolls 34. Soil upon the rolls 34 is subsequently removed as the revolving rolls 34 are rewetted and extracted. In turn, the soil transfer roll cleaning process repeats as a cycle with rolls 34 revolving so that cleaning liquid 14 is applied to one portion, extractors 56, 58 reduce the relative wetness of another portion of rolls 34 (and removing soiled solution therefrom), and yet another portion of rolls 34 wipe the surface 20 to transfer soil from the surface to the rolls 34.

Additional aspects of the present invention will be addressed. It is envisioned that the cleaning processes according to the present invention may be performed on a variety of different machines, ranging from small manually operated devices, to large operator driven vehicles. The illustrated device is a walk-behind type cleaning machine, more particularly a battery powered self-propelled machine. In alternative embodiments, machine 10 may be propelled by an operator or may include a vehicle, such as a ride-on or towed-behind vehicle. Machine 10 may be powered through battery power, as shown, through alternating current supplied through a cord, or through another type of on-board power source, such as an IC engine.

Embodiments of the present invention may be utilized for cleaning a variety of floor surfaces, including but not limited to carpets, rugs, tile, vinyl, terrazzo, wood floors, and concrete surfaces. Additional surfaces which may be cleaning through a process as described herein include walls, stairways, upholstered furniture or fabric, such as curtains and the like. In a particularly preferred embodiment and as described herein with reference to machine 10 operation, the present invention is utilized for cleaning floor coverings.

In another embodiment soil transfer rolls 34 may be cylindrical shaped elements having a combination of foam and bristle surfaces (not shown). Rolls 34 may include a variety of different materials including fabrics, synthetic scouring pads, foam elements, monofilament fibers for enhancing agitation of the carpet, and the like which serve the intended function of transferring soil from a surface being wiped onto the soil transfer roll 34.

Extractors 54, 56, 58 may be provided by a wide array of structures and techniques as may be appreciated by those skilled in the relevant arts. One particular extractor technology is disclosed in U.S. application Ser. No. 10/236,746, entitled "Fluid Recovery Device", assigned to Tennant Company, and incorporated in its entirety herein by reference.

Further, although a preferred cleaning solution dispensing means includes a pump 46, other arrangements are of course possible so as to achieve the intended function of conveying cleaning solution 14 during the cleaning processes. Additionally, the cleaning liquid may comprise any cleaning solution which assists the transfer of the soil on the surface onto the cleaning medium. For example, cleaning liquid 14 could also be in the form of a foam, vapor, liquid with suspended solids, a granular cleaning material, plain water, and the like.

Other modifications to the described embodiment may also be practicable. One or more cleaning liquid dispensing devices may be utilized in alternative embodiments of the invention. Additionally, vacuum extractor tools 56, 58 may be alternatively configured. For example, a plurality of vacuum extracting locations may be practicable, i.e., a first vacuum extraction location for reducing the relative dampness of the rotating cleaning medium prior to contact with the floor surface, and a second vacuum extraction location for removing soiled solution from the cleaning medium.

Other embodiments of the present invention may position vacuum extractor tools 56, 58 at different locations as compared to FIGS. 1–3. For example, it may be desirable to extract a portion of cleaning implement 34 after that portion is wiped against the carpet. In this manner, the steps of operation would include wetting a portion of cleaning implement 34, wiping that portion of cleaning implement 34 against the carpet surface, and then extracting that portion to removed soiled cleaning solution. A modification to the illustrated embodiment of FIGS. 1–3 could entail positioning extractors 56, 58 between motors 28. Other positions of extractors 56, 58 may also be practicable. Extractors 54, 56, 58 may each be independently movable between an operational position and a nonoperational position. For example, extractor 54 may engage carpet surface 20 as indicated in FIG. 2 during a first mode of machine operation and be moved away from carpet surface 20 as indicated in FIG. 3 during a second mode of operation. In another example, extractors 56, 58 may be selectively moved relative to rolls 34 and/or brushes 32 to increase or decrease the distance between the elements. The positioning of extractors 54, 56, 58 may be electro-mechanically or manually controlled.

Other embodiments of the present invention may utilize a different drive system to power rolls 34 and/or brushes 32. A single electric motor may be one option. Mounting and support structures for the rolls 34 and/or brushes 32 may also vary. Rolls 34 may be held upon a wire frame, similar to a paint roller, and allow for removal from one side of the machine. Other roll 34/brush 32 connections would be appreciated by those of ordinary skill in the arts. The direction of rotation of rolls 34/brushes 32 may be altered from that illustrated in the preferred embodiment. Three or more rolls 34 and/or brushes 32 may be practicable. Roll 34 and brush 32 rotational speed may be selectively controlled so that speeds differ between differ modes of operation. Down pressure of rolls 34 and brushes 32 may be selectively controlled so that the down pressures differ between modes of operation. Additional spray nozzles may be desirable to convey cleaning solution 14 to rolls 34, brushes 32, or surface 20. A system may be provided to momentarily increase the application of cleaning solution 14 to the various components or surface 20. Such a system may include a button or other switch to activate additional nozzles, etc. for a predetermined period of time.

In the preferred embodiment of the invention as illustrated in FIG. 1, the revolving cleaning implement is roll 34. Roll 34 may be constructed of nylon fibers secured to a polypropylene core. Other materials or material combinations would be appreciated by those of ordinary skill in the arts. In alternative embodiments, the revolving cleaning medium may be a belt (not shown). A belt comprised of a substrate, such as a woven synthetic fabric, having pile fibers tufted thereinto may be practicable. In some instances it may be desirable to tuft stiffer monofilament fibers into the fabric substrate to enhance the agitating action of the belt. The softer pile fibers tufted into the fabric serve to carry cleaning liquid, while the stiffer monofilament fibers serve to scrub the carpet. The belt may be supported between rollers and driven via a variety of known approaches. U.S. Pat. No. 6,145,145, incorporated by reference herein, discloses a belt technology which may be applicable to the present invention.

Definitions are provided herein with reference to terms used in the specification and appended claims:

"Cleaning Medium": a part, component, assembly, or structure capable of engaging a carpet or other surface in a wiping manner and accepting soil from the carpet or other surface. A cleaning medium may assume a variety of shapes, including but not limited to roll-like brushes, belts, disk-shaped elements, etc. A cleaning medium may consist of a variety of different materials of construction, such as absorbent and nonabsorbent materials, bristle-type materials, abrasive elements, fabric, etc.

"Revolving": Tending to revolve or happen repeatedly, available at regular intervals. As used herein, the term broadly describes a cyclical movement of the cleaning medium relative to surface 20. A cylindrical shaped "revolving" cleaning medium may be rotate about an axis of rotation. A belt shaped "revolving" cleaning medium may be supported for movement about a pair of rollers, etc.

"Extracting": Drawing or pulling out, using force or effort, to remove or obtain from a substrate by mechanical action, as by mechanical pressure or vacuum. As used herein, the term broadly describes the step of removing cleaning liquid and/or soil from the rolls 34 or surface 20. The step of extracting may be achieved through a mechanical shearing type operation, or a vacuum removal operation, or both.

"Wipe": To rub against or otherwise engage a surface in a moving manner. As used herein, the term broadly describes physical engagement between the cleaning medium and surface 20. In one mode of machine operation, rolls 34 engage surface 20 in a "wiping" manner to transfer soil from surface 20 to roll 34. Wiping does not necessarily imply or suggest removing liquid from surface 20. Cleaning rolls 34 when wiped against the carpet surface may transfer some cleaning liquid to the carpet surface.

As various changes could be made in the above methods and devices without departing from the scope of the invention, it is intended that all matter contained in the above description or shown in the accompanying drawings shall be interpreted as illustrative and not in a limiting sense.

We claim:

1. A surface maintenance device for performing a plurality of surface cleaning processes, comprising:

a revolving cleaning implement which wipingly engages a surface intended to be cleaned;

a cleaning solution dispenser which selectively wets with a cleaning solution a portion of the cleaning implement or the surface intended to be cleaned or both; and at least a pair of vacuum extractor tools, a first one of the pair being in engagement with the cleaning implement during a first mode of operation, and a second one of the pair being in engagement with the surface to be cleaned during a second mode of operation, wherein during the first mode of operation said first vacuum extractor tool removes some of a dispensed cleaning solution from the previously wetted portion of the revolving cleaning implement prior to the portion being wiped against the surface intended to be cleaned, wherein soil from the surface intended to be cleaned is transferred to said portion of the cleaning implement as said portion is wiped against the surface intended to be cleaned, said portion being subsequently rewetted and extracted so as to remove soil previously transferred to the cleaning implement, and wherein during the second mode of operation said second vacuum extractor tool removes a soiled cleaning solution directly from the surface intended to be cleaned.

2. The surface maintenance device of claim 1 wherein the cleaning solution dispenser includes at least one nozzle which sprays cleaning solution onto the cleaning implement or the surface intended to be cleaned or both.

3. The surface maintenance device of claim 1 wherein the cleaning solution dispenser includes a plurality of nozzles, at least one of said plurality of nozzles spraying cleaning solution onto the surface intended to be cleaned and at least one of said plurality of nozzles spraying cleaning solution on the cleaning implement.

4. The surface maintenance device of claim 1 wherein a substantially higher flow rate of cleaning solution is dispensed onto the surface intended to be cleaned as compared to a flow rate of cleaning solution dispensed onto the cleaning implement.

5. The surface maintenance device of claim 1 further comprising a soiled solution recovery tank in fluid communication with at least one of the pair of vacuum extractor tools.

6. The surface maintenance device of claim 1 wherein the pair of vacuum extractor tools are selectively controlled during the plurality of surface cleaning processes.

7. The surface maintenance device of claim 6 wherein a common vacuum conduit is in selective communication with one of the pair of vacuum extractor tools.

8. The surface maintenance device of claim 1 wherein the cleaning implement includes at least one generally cylindrical shaped element.

9. The surface maintenance device of claim 8 wherein the cleaning implement is a cylindrical brush including one or more of: bristles, fibers, fabric material and scouring pads.

10. The surface maintenance device of claim 8 wherein the cleaning implement includes a pair of cylindrical brushes.

11. The surface maintenance device of claim 10 wherein each of the pair of cylindrical brushes includes pile fabric and relatively large monofilament fibers for enhancing agitation of a carpet surface.

12. The surface maintenance device of claim 10 wherein the pair of cylindrical brushes are counter-rotated relative to each other.

13. The surface maintenance device of claim 10 further comprising a third vacuum extractor tool, the first vacuum extractor tool engaging one of the pair of cylindrical brushes and the third vacuum extractor tool engaging the other one of the pair of cylindrical brushes.

14. The surface maintenance device of claim 1 wherein the surface is a carpet surface, and wherein the cleaning implement transfers soil from fibers of the carpet surface and the vacuum extractor tools remove soiled cleaning solution from the cleaning implement or the carpet or both.

15. A surface maintenance machine comprising:

a cleaning implement in selective wiping contact with a surface intended to be cleaned;

a cleaning solution dispenser which selectively wets with a cleaning solution a portion of the cleaning implement or a portion of the surface or both;

a first selectively controllable vacuum extractor tool, when operating said tool removes some of the dispensed cleaning solution and soil from the cleaning implement; and a second selectively controllable vacuum extractor tool, when operating said tool removes soil and some of the cleaning solution directly from the surface intended to be cleaned.

16. The surface maintenance machine of claim 15 wherein the first and second selectively controllable vacuum extractor tools are selectively controlled so that one of the vacuum extractor tools is operational while the other vacuum extractor tool is nonoperational.

17. The surface maintenance machine of claim 16 wherein the first and second selectively controllable vacuum extractor tools are provided in fluid communication with a fluid recovery tank through a common vacuum conduit.

18. The surface maintenance machine of claim 15 wherein said portion of the cleaning implement is extracted to remove some of the dispensed cleaning solution prior to said portion being wiped against the surface intended to be cleaned, said portion being subsequently rewetted and extracted so as to remove soil from the cleaning implement.

19. The surface maintenance machine of claim 15 further comprising a second cleaning implement and a third vacuum extractor tool in operative engagement with the second cleaning implement.

20. The surface maintenance machine of claim 19 wherein the cleaning solution dispenser conveys cleaning solution to both of the cleaning implements and the first and third selectively controllable vacuum extractor tools remove some of the cleaning solution from portions of the cleaning implements prior to said portions being wiped against the surface intended to be cleaned.

21. The surface maintenance machine of claim 19 further comprising a soiled solution recovery tank, said first and third vacuum extractor tools being in fluid communication with the recovery tank.

22. The surface maintenance machine of claim 15 wherein each of the first and second selectively controllable vacuum extractor tools are configured differently relative to the other.

23. The surface maintenance machine of claim 15 wherein the cleaning solution dispenser includes a plurality of nozzles for spraying cleaning solution onto the cleaning implement or the surface intended to be cleaned or both.

24. The surface cleaning machine of claim 15 further comprising cleaning solution control means for controlling an amount of cleaning solution applied to the cleaning implement and the surface intended to be cleaned between different surface cleaning processes.

25. A multi-mode carpet cleaning machine comprising:

a pair of rotating cylindrical cleaning implements in wiping contact with a carpet;

a cleaning solution dispenser which selectively dispenses cleaning solution to a portion of the cleaning implements or a portion of the carpet or both;

a first vacuum extractor tool which removes some of the dispensed cleaning solution and soil from one of the cleaning implements during a first mode of operation;

a second vacuum extractor tool which removes some of the dispensed cleaning solution and soil from the other one of the cleaning implements during the first mode of operation; and a third vacuum extractor tool in operative engagement with the carpet to remove some of the cleaning solution dispensed onto the carpet during a second mode of operation.

26. The carpet cleaning machine of claim 25 further comprising a fluid recovery tank in selective communication with at least one of the first, second or third vacuum extractor tools.

27. The carpet cleaning machine of claim 25 wherein the cleaning implements include a pile fabric and relatively stiff monofilament fibers to enhance agitation of the carpet.

28. The carpet cleaning machine of claim 25 wherein the cleaning solution dispenser dispenses cleaning solution to portions of the cleaning implements and the first and second vacuum extractors remove cleaning solution and soil from said portions prior to said portions being wiped against the carpet.

29. A method of cleaning a carpeted surface utilizing a dual mode cleaning machine comprising the steps of:

operating the cleaning machine in a first mode of operation by:

wetting a portion of a revolving cleaning medium of the machine with a cleaning liquid;

extracting some soil and at least some of the cleaning solution from the portion of the revolving cleaning medium; and wiping a carpeted surface with said portion of the revolving cleaning medium so as to transfer soil from the carpeted surface to the revolving cleaning medium, and operating the cleaning machine in a second mode of operation by:

wetting a portion of the carpeted surface;

engaging the portion of the carpeted surface with the revolving cleaning medium of the machine; and extracting at least some of the soiled cleaning solution directly from the carpeted surface.

30. The method of cleaning a carpeted surface of claim 29 further comprising the steps of repeating the first mode and second mode of operation during a cleaning process.

31. The method of cleaning a carpeted surface of claim 29 wherein the step of extracting occurs prior to the step of wiping.

32. The method of cleaning a carpeted surface of claim 29 wherein the step of extracting occurs after the step of wiping.

33. A method of cleaning a carpeted surface utilizing a dual mode cleaning machine comprising the steps of:

operating the cleaning machine in a first mode of operation by:

spraying an amount of cleaning liquid onto a revolving cleaning medium of the machine;

vacuuming at least some soil and at least some of the cleaning liquid from the revolving cleaning medium; and wiping a carpeted surface with the revolving cleaning medium so as to transfer soil from the carpeted surface to the revolving cleaning medium, and subsequently operating the cleaning machine in a second mode of operation by:

spraying another amount of cleaning liquid onto the carpeted surface; and vacuuming at least some soil and at least some of the cleaning liquid directly from the carpeted surface.

34. The method of claim 33 further comprising the step of:

engaging the carpeted surface with the revolving cleaning in the second mode of operation.

35. The method of claim 33 further comprising the step of:

spraying another amount of cleaning liquid onto the cleaning medium in the second mode of operation.

* * * * *

UNITED STATES PATENT AND TRADEMARK OFFICE

CERTIFICATE OF CORRECTION

PATENT NO. : 6,735,812 B2 
DATED : May 18, 2004
INVENTOR(S) : Fredrick A. Hekman, Jeffrey D. Fystrom and Larry D. Wydra It is certified that error appears in the above-identified patent and that said Letters Patent is hereby corrected as shown below:

Column 12,
Line 56, insert -- medium -- after "cleaning".

Signed and Sealed this

Nineteenth Day of July, 2005

JON W. DUDAS
*Director of the United States Patent and Trademark Office*